US010179357B2

(12) United States Patent
Ito

(10) Patent No.: US 10,179,357 B2
(45) Date of Patent: Jan. 15, 2019

(54) BENDING APPARATUS AND BENDING METHOD FOR A PLATE-SHAPED METAL WORKPIECE

(71) Applicant: AIDA ENGINEERING, LTD., Kanagawa (JP)

(72) Inventor: Takao Ito, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 0 days.

(21) Appl. No.: 15/053,953

(22) Filed: Feb. 25, 2016

(65) Prior Publication Data

US 2016/0250675 A1 Sep. 1, 2016

(30) Foreign Application Priority Data

Feb. 27, 2015 (JP) ..... 2015-038175

(51) Int. Cl.
*B21D 25/02* (2006.01)
*B21D 11/20* (2006.01)
(Continued)

(52) U.S. Cl.
CPC ..... *B21D 11/20* (2013.01); *B21D 11/02* (2013.01); *B21D 22/06* (2013.01); *B21D 25/02* (2013.01); *B21D 37/02* (2013.01); *B21D 53/92* (2013.01)

(58) Field of Classification Search
CPC . B21D 7/02; B21D 7/04; B21D 22/10; B21D 25/02; B21D 25/04; B21D 37/12;
(Continued)

(56) References Cited

U.S. PATENT DOCUMENTS 2,437,092 A * 3/1948 Greene, Jr. ..... B21D 11/02 72/18.4
4,088,312 A * 5/1978 Frosch ..... B25B 11/005 269/21
(Continued)

FOREIGN PATENT DOCUMENTS

DE 621397 C * 11/1935 ..... B21D 11/02
JP S52-139336 U 10/1977
(Continued)

OTHER PUBLICATIONS

Office Action issued in related Japanese Application No. 2015-038175, dated Jun. 8, 2016.
(Continued)

*Primary Examiner* — Pradeep C Battula
(74) *Attorney, Agent, or Firm* — McDermott Will & Emery LLP

(57) ABSTRACT

Provided is a bending apparatus for a plate-shaped metal workpiece, including: a suction device (suction pad) configured to suck a surface of a plate-shaped metal workpiece in a removable manner; a plurality of expansion and contraction devices (servo screw jacks) each including the suction device mounted on a distal end thereof and being capable of expanding and contracting a length ranging from a proximal end thereof to the suction device; and an apparatus base (bed) on which the proximal end of each of the expansion and contraction devices is mounted. The bending apparatus is configured to form the plate-shaped metal workpiece under bending deformation by expanding and contracting the expansion and contraction devices under a state in which the suction device sucks the surface of the plate-shaped metal workpiece.

34 Claims, 9 Drawing Sheets

(51) Int. Cl.
*B21D 11/02* (2006.01)
*B21D 22/06* (2006.01)
*B21D 37/02* (2006.01)
*B21D 53/92* (2006.01)

(58) Field of Classification Search
CPC ..... B21D 53/92; B21D 37/10; B21D 37/02; B21D 22/06; B21D 11/20; B21D 11/10; B21D 11/02; B25B 11/005
See application file for complete search history.

(56) References Cited

U.S. PATENT DOCUMENTS 4,684,113 A * 8/1987 Douglas ..... B25B 11/005 269/21
4,770,017 A * 9/1988 Yamashita ..... B21D 11/20 72/168
5,187,969 A * 2/1993 Morita ..... B21D 53/886 29/896.91
5,372,357 A * 12/1994 Blaimschein ..... B25B 11/007 269/21
5,481,897 A * 1/1996 Jessop ..... B21D 7/04 72/381
5,546,784 A * 8/1996 Haas ..... B21D 37/02 72/413
6,089,061 A 7/2000 Haas et al.
6,209,188 B1 * 4/2001 Soderberg ..... B25B 11/005 269/20
6,216,508 B1 * 4/2001 Matsubara ..... B21D 22/00 72/125
6,298,896 B1 * 10/2001 Sherrill ..... B29C 33/0011 156/581
6,578,399 B1 * 6/2003 Haas ..... B21D 22/10 72/342.1
8,118,959 B2 * 2/2012 Nelson ..... B29C 33/308 156/220
8,544,312 B2 * 10/2013 Imai ..... B21D 22/00 269/21

FOREIGN PATENT DOCUMENTS

JP 58-135727 A 8/1983
JP S63-053316 U 4/1988
JP H09-155457 A 6/1997
JP 2000-117331 A 4/2000
JP 2002-233923 A 8/2002
JP 2002-301526 A 10/2002
JP 2011-194426 A 10/2011
JP 2012-213792 A 11/2012
KR 2009-0100306 A 9/2009

OTHER PUBLICATIONS

Extended European Search Report issued in corresponding EP Application No. 16156246.7, dated Jun. 24, 2016.
Japanese Office Action dated Dec. 5, 2017 issued in Japanese Patent Application No. 2016-250205 (with English translation).
Chinese Office Action issued in corresponding Chinese Patent Application No. 201610108929.5, dated Aug. 27, 2018.

* cited by examiner

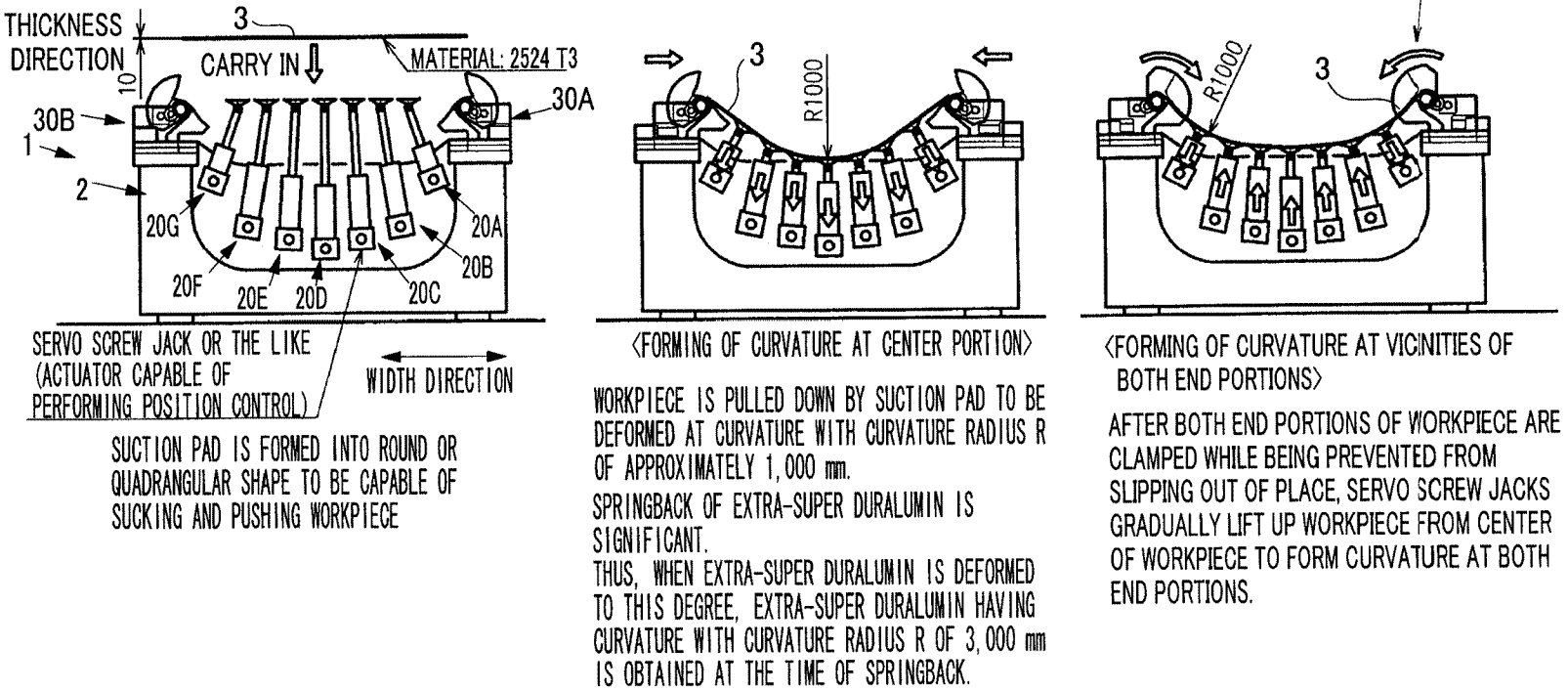
FIG.1C
THICKNESS DIRECTION
10
30B
1
2
3
CARRY IN
MATERIAL: 2524 T3
30A
20A
20B
20C
20D
20E
20F
20G
WIDTH DIRECTION
SERVO SCREW JACK OR THE LIKE (ACTUATOR CAPABLE OF PERFORMING POSITION CONTROL)
SUCTION PAD IS FORMED INTO ROUND OR QUADRANGULAR SHAPE TO BE CAPABLE OF SUCKING AND PUSHING WORKPIECE
FIG.1D
R1000
3
<FORMING OF CURVATURE AT CENTER PORTION>
WORKPIECE IS PULLED DOWN BY SUCTION PAD TO BE DEFORMED AT CURVATURE WITH CURVATURE RADIUS R OF APPROXIMATELY 1,000 mm.
SPRINGBACK OF EXTRA-SUPER DURALUMIN IS SIGNIFICANT.
THUS, WHEN EXTRA-SUPER DURALUMIN IS DEFORMED TO THIS DEGREE, EXTRA-SUPER DURALUMIN HAVING CURVATURE WITH CURVATURE RADIUS R OF 3,000 mm IS OBTAINED AT THE TIME OF SPRINGBACK.
FIG.1E
WORKPIECE BENDER-CUM-CLAMP MEMBER
R1000
3
<FORMING OF CURVATURE AT VICINITIES OF BOTH END PORTIONS>
AFTER BOTH END PORTIONS OF WORKPIECE ARE CLAMPED WHILE BEING PREVENTED FROM SLIPPING OUT OF PLACE, SERVO SCREW JACKS GRADUALLY LIFT UP WORKPIECE FROM CENTER OF WORKPIECE TO FORM CURVATURE AT BOTH END PORTIONS.

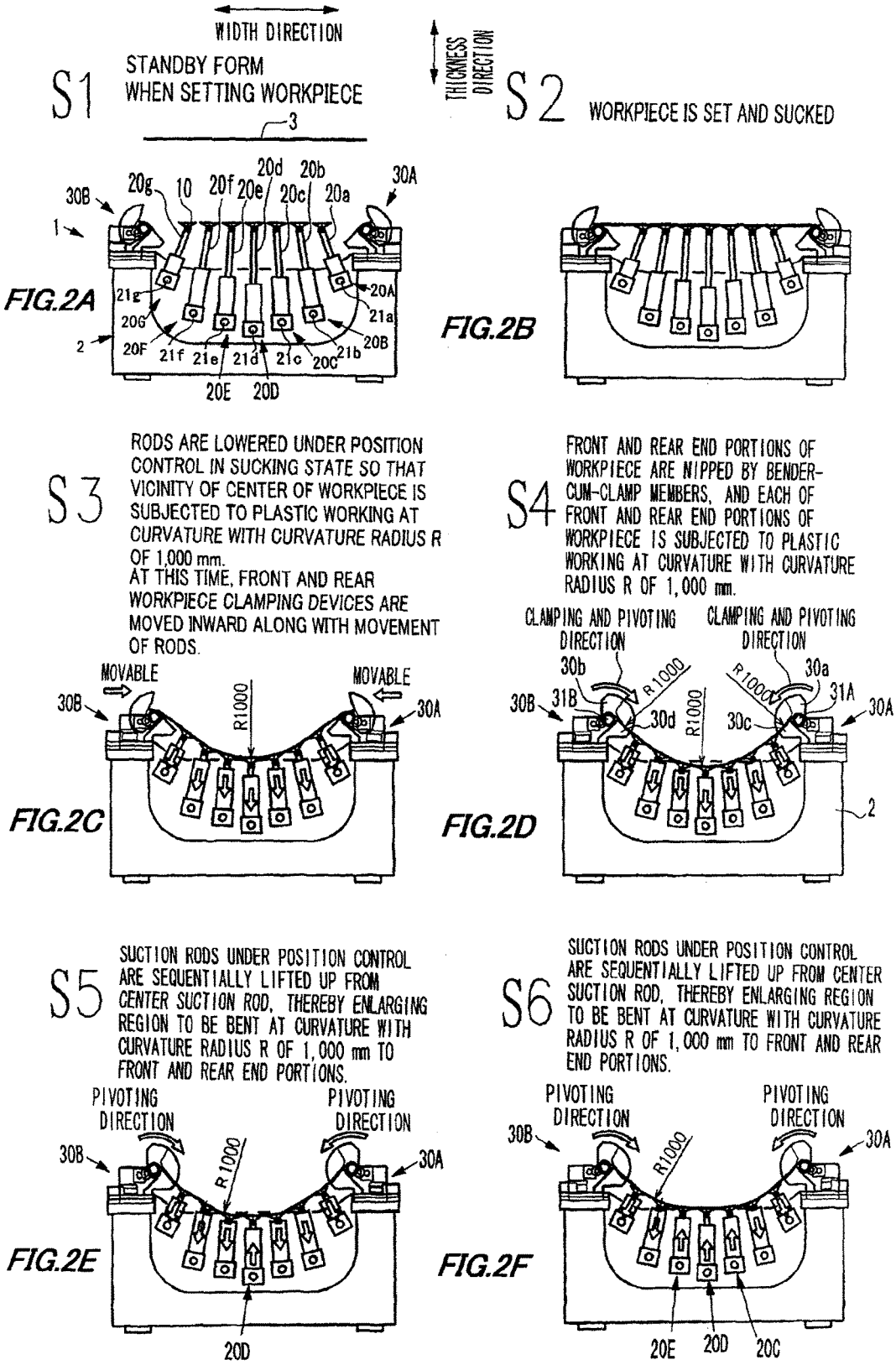
WIDTH DIRECTION
THICKNESS DIRECTION
S1
STANDBY FORM WHEN SETTING WORKPIECE
S2
WORKPIECE IS SET AND SUCKED
FIG.2A
FIG.2B
S3
RODS ARE LOWERED UNDER POSITION CONTROL IN SUCKING STATE SO THAT VICINITY OF CENTER OF WORKPIECE IS SUBJECTED TO PLASTIC WORKING AT CURVATURE WITH CURVATURE RADIUS R OF 1,000 mm.
AT THIS TIME, FRONT AND REAR WORKPIECE CLAMPING DEVICES ARE MOVED INWARD ALONG WITH MOVEMENT OF RODS.
S4
FRONT AND REAR END PORTIONS OF WORKPIECE ARE NIPPED BY BENDER-CUM-CLAMP MEMBERS, AND EACH OF FRONT AND REAR END PORTIONS OF WORKPIECE IS SUBJECTED TO PLASTIC WORKING AT CURVATURE WITH CURVATURE RADIUS R OF 1,000 mm.
CLAMPING AND PIVOTING DIRECTION
MOVABLE
R1000
FIG.2C
FIG.2D
S5
SUCTION RODS UNDER POSITION CONTROL ARE SEQUENTIALLY LIFTED UP FROM CENTER SUCTION ROD, THEREBY ENLARGING REGION TO BE BENT AT CURVATURE WITH CURVATURE RADIUS R OF 1,000 mm TO FRONT AND REAR END PORTIONS.
S6
SUCTION RODS UNDER POSITION CONTROL ARE SEQUENTIALLY LIFTED UP FROM CENTER SUCTION ROD, THEREBY ENLARGING REGION TO BE BENT AT CURVATURE WITH CURVATURE RADIUS R OF 1,000 mm TO FRONT AND REAR END PORTIONS.
PIVOTING DIRECTION
FIG.2E
FIG.2F

WIDTH DIRECTION

THICKNESS DIRECTION

S7 SUCTION RODS UNDER POSITION CONTROL ARE SEQUENTIALLY LIFTED UP FROM CENTER SUCTION ROD, THEREBY ENLARGING REGION TO BE BENT AT CURVATURE WITH CURVATURE RADIUS R OF 1,000 mm TO FRONT AND REAR END PORTIONS.

S8 SUCTION RODS UNDER POSITION CONTROL ARE SEQUENTIALLY LIFTED UP FROM CENTER SUCTION ROD, THEREBY ENLARGING REGION TO BE BENT AT CURVATURE WITH CURVATURE RADIUS R OF 1,000 mm TO FRONT AND REAR END PORTIONS.

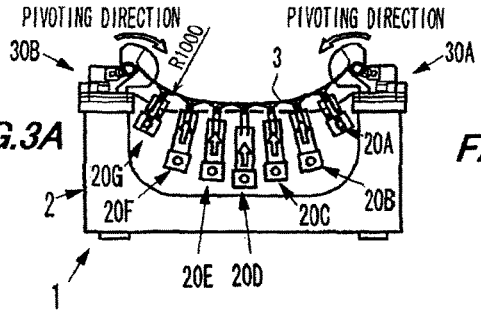

FIG.3A

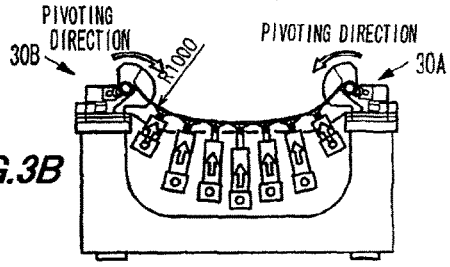

FIG.3B

S9 AFTER FINISH OF FORMING REGION WITH CURVATURE RADIUS R OF 1,000 mm AT FRONT AND REAR END PORTIONS, END PORTION CLAMPING DEVICES ARE RELEASED.

S10 <MEASUREMENT OF CURVED SHAPE IN NO DEFLECTING STATE> HITHERTO, IT HAS NOT BEEN POSSIBLE TO MEASURE ACTUAL DIMENSION OF WORKPIECE BECAUSE OF DEFLECTION OF WORKPIECE DUE TO SELF-WEIGHT. POSITION CONTROL IS PERFORMED SO AS TO EQUALLY DISTRIBUTE MASS OF RODS, THEREBY BEING CAPABLE OF MEASURING ACTUAL DIMENSION FREE FROM DEFLECTION DUE TO SELF-WEIGHT.

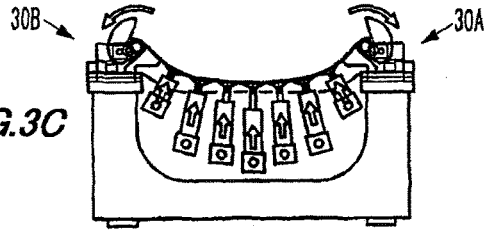

FIG.3C

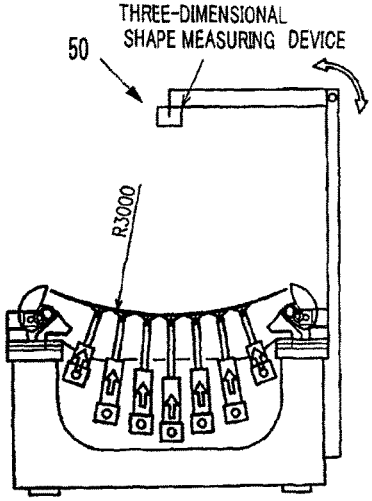

FIG.3D

S11 COMPLETION OF BENDING

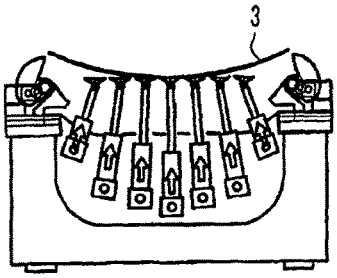

FIG.3E

METHOD OF SETTING ROCKING ANGLE POSITIONS OF RODS AT THE TIME OF SUCKING

CONTROL OF ROCKING ANGLES PERFORMED BY SERVOMOTORS

SETTING OF INITIAL POSITIONS PERFORMED BY SPRINGS

WIDTH DIRECTION OF PLATE-SHAPED WORKPIECE
CLAMPING AND PIVOTING DIRECTION
CLAMPING AND PIVOTING DIRECTION
30B
31B
30b
30d
3
30a
30c
31A
30A
20G
20F
20E
20D
20C
20B
20A
2
1
PRESS FORMING BOTH END PORTIONS

WIDTH DIRECTION OF PLATE-SHAPED WORKPIECE
RELEASING DIRECTION
RELEASING DIRECTION
R1000
30B
31B
30b
30d
3
30a
30c
31A
30A
20G
20F
20E
20D
20C
20B
20A
2
WHEN FORMING ONE END OF PLATE-SHAPED WORKPIECE

CYLINDRICAL BENDING BY THREE-POINT BENDING

BENDING APPARATUS AND BENDING METHOD FOR A PLATE-SHAPED METAL WORKPIECE

BACKGROUND OF THE INVENTION

1. Field of the Invention

The present invention relates to a technology of bending a metal plate, such as a plate-shaped metal workpiece (plate-shaped workpiece) used as an outer-plate (or a skin) of an aircraft, into an arc shape (cylindrical shape) at a predetermined curvature.

2. Description of the Related Art

Hitherto, an outer shell of an aircraft (having a substantially cylindrical shape in horizontal cross-section) is obtained by coupling together several outer-plates (skins) of the aircraft each bent at a predetermined curvature (for example, each having approximately a size of a thickness of from 2 mm to 10 mm×a width of 2.5 m×a length of from 6 m to 10 m) so as to be formed into a cylindrical shape. Accordingly, outer-plate (or skin) workpieces (plate-shaped workpieces) each cut into a predetermined size are subjected to tip forming by a large-sized press brake (forming machine) one by one (three-point bending (see FIG. 8) is performed repeatedly at intervals of approximately 20 mm about one hundred and twenty five times, or three-point bending is performed more times when adjustment of a curvature is necessary), thereby forming each of the outer-plate workpieces (by cylindrical bending or constant curvature bending) into a single contour having a curvature radius R of approximately 3,000 mm. Then, the plurality of outer-plate workpieces (plate-shaped workpieces) each formed to have the predetermined curvature are coupled together, thereby obtaining the outer shell of the aircraft.

In this case, in order to reduce a weight of the aircraft, a plurality of pocket grooves (dents) are formed on an inner side (side to be punched) of the outer-plate of the aircraft, which is to be subjected to cylindrical bending. There are actually a variety of shape patterns of the pocket grooves (dents) (see reference symbol 3A in FIG. 1B, and FIG. 8).

When a region having the pocket grooves (dents) formed therein is subjected to cylindrical bending, as illustrated in FIG. 8, a board (such as a cardboard (filler having a hardness nearly equal to a hardness of a plate)), which conforms to a size and a shape of each of the pocket grooves, is placed in advance (embedded or fitted) in each of the pocket grooves (for example, see Japanese Patent Application Laid-open No. 2012-213792 and Japanese Patent Application Laid-open No. 2011-194426), and forming is performed under a state in which concaves and convexes are eliminated (a thickness of an entire region of the outer-plate workpiece is equalized). In this manner, a product formed into a uniform contour (product bent into a cylindrical shape with a predetermined curvature) is obtained.

In this case, in order to obtain a predetermined contour (curvature or profile), every time pressing operation is performed several times, an operator needs to measure the contour, and to minutely adjust a pushing amount of a punch.

It is necessary to minutely adjust a thickness of the cardboard (filler) in order to minutely adjust the pushing amount of the punch. Operation itself of embedding the cardboard into each of the pocket grooves is complicated and requires a long period of time. In addition, even a skilled worker spends a long period of time to minutely adjust the thickness of the cardboard (minutely adjust a height thereof). Accordingly, in actuality, it takes, for example, four hours to form and complete one outer-plate.

In addition, the outer-plate workpiece (plate-shaped workpiece) of the aircraft is a significantly large component having a width dimension of approximately 2.5 m and a length dimension (longitudinal dimension) of approximately from 6 m to 10 m, despite of a small thickness of approximately from 2 mm to 10 mm. Therefore, the outer-plate workpiece deflects due to a self-weight after forming. Accordingly, when the contour is measured in the deflecting state, in actuality, it is difficult to conduct with good accuracy an inspection of whether or not the predetermined curvature is obtained, and a skill is required.

Further, in order to prevent damage to the outer-plate workpiece at the time of forming, rubber is wound around the punch, and a cover plate (which is a member softer than the outer-plate workpiece) is laid on a die. Accordingly, forming accuracy changes due to aged deterioration of the rubber and the cover plate. Thus, in actuality, it is difficult to perform forming at fixed accuracy for a long period of time. Further, in a tip forming method, a distance between front and rear bearing points of the die (see FIG. 8) is small. As a result, a load applied to deform the workpiece is increased, and a press is required to have high capacity.

Further, hitherto, the outer-plate (or skin) has been formed by the tip forming method using the press brake (forming machine). Accordingly, in order to receive the outer-plate workpiece having the length dimension (longitudinal dimension) of approximately from 6 m to 10 m, a large-sized press brake having a frontage (column interval) of 10 m or more has been needed.

Accordingly, as illustrated in FIG. 7A and FIG. 7B, a slide (punch) of the press brake deflects, and hence has an immense size in order to ensure rigidity (to suppress longitudinal deflection), which leads to increase of mass and increase of operation energy. In addition, a long period of time is needed to store the operation energy, and a long operation cycle is needed. Thus, in actuality, production efficiency of the press brake is low.

Adoption of a three-point press forming method (FIG. 8) employing the tip forming method when bending the outer-plate of the aircraft into a cylindrical shape is considered as a cause of the following: work that has hitherto required a long period of working hours (work of embedding cardboards into the pocket grooves (dents) and work of forming the outer-plate in while minutely adjusting thicknesses of the cardboards); and the press brake (forming machine) having an immense size and a wide frontage for receiving a large workpiece.

In this context, it is desired to create a new forming method that needs no work of filling the pocket grooves even when any patterns of pocket grooves are formed, is capable of obtaining a product shape in several forming steps, and needs no large-sized forming machine.

SUMMARY OF THE INVENTION

According to one embodiment of the present invention, there is provided a bending apparatus for a plate-shaped metal workpiece, including:

a suction device configured to suck a surface of a plate-shaped metal workpiece in a removable manner;

a plurality of expansion and contraction devices each including the suction device mounted on a distal end thereof, each of the plurality of expansion and contraction devices being capable of expanding and contracting a length ranging from a proximal end thereof to the suction device; and an apparatus base on which the proximal end of each of the plurality of expansion and contraction devices is mounted, the bending apparatus being configured to form the plate-shaped metal workpiece under bending deformation by expanding and contracting the plurality of expansion and contraction devices under a state in which the suction device sucks the surface of the plate-shaped metal workpiece.

In the one embodiment of the present invention, the proximal end may be pivotable with respect to the apparatus base.

In the one embodiment of the present invention, the bending apparatus for a plate-shaped metal workpiece may further include a clamping device configured to clamp an end portion of the plate-shaped metal workpiece in a thickness direction of the plate-shaped metal workpiece in a releasable manner, and the plate-shaped metal workpiece may be formed under bending deformation in such a manner that the clamping device is pivoted with respect to the apparatus base while clamping the end portion of the plate-shaped metal workpiece in the thickness direction.

In the one embodiment of the present invention, the clamping device may be movable in a width direction of the plate-shaped metal workpiece.

In the one embodiment of the present invention, expansion and contraction amounts of the plurality of expansion and contraction devices may be controllable.

In the one embodiment of the present invention, after forming the plate-shaped metal workpiece under bending deformation by expanding or contracting the plurality of expansion and contraction devices in the same direction, the bending apparatus may form the plate-shaped metal workpiece under bending deformation by expanding or contracting the plurality of expansion and contraction devices in a direction opposite to the same direction in sequential order from an innermost expansion and contraction device toward an outermost expansion and contraction device.

According to one embodiment of the present invention, there is provided a bending method for a plate-shaped metal workpiece, including, by using a bending apparatus for a plate-shaped metal workpiece including:

a suction device configured to suck a surface of a plate-shaped metal workpiece in a removable manner;

a plurality of expansion and contraction devices each including the suction device mounted on a distal end thereof, each of the plurality of expansion and contraction devices being capable of expanding and contracting a length ranging from a proximal end thereof to the suction device; and an apparatus base on which the proximal end of each of the plurality of expansion and contraction devices is mounted, forming the plate-shaped metal workpiece under bending deformation by expanding and contracting the plurality of expansion and contraction devices under a state in which the suction device sucks the surface of the plate-shaped metal workpiece.

In the one embodiment of the present invention, the bending method for a plate-shaped metal workpiece further includes, after forming the plate-shaped metal workpiece under bending deformation by expanding or contracting the plurality of expansion and contraction devices in the same direction, forming the plate-shaped metal workpiece under bending deformation by expanding or contracting the plurality of expansion and contraction devices in a direction opposite to the same direction in sequential order from an innermost expansion and contraction device toward an outermost expansion and contraction device.

BRIEF DESCRIPTION OF THE DRAWINGS

FIG. 1C to FIG. 1E are side views of the bending apparatus for a plate-shaped metal workpiece when viewed from a width direction of the bending apparatus.

FIG. 2A to FIG. 2F are side views for respectively illustrating Step 1 to Step 6 of forming steps of the bending apparatus (method) for a plate-shaped metal workpiece according to the embodiment of the present invention.

FIG. 3A to FIG. 3E are side views for illustrating Step 7 to Step 11 of the forming steps of the bending apparatus (method) for a plate-shaped metal workpiece according to the embodiment of the present invention.

DETAILED DESCRIPTION OF THE PREFERRED EMBODIMENTS

The present invention has been made in view of the above-mentioned circumstances, and has an object to provide a bending apparatus and a bending method for a plate-shaped metal workpiece, which are capable of forming (bending into a cylindrical shape) a plate-shaped metal workpiece for an outer-plate (or a skin) of an aircraft and the like at a predetermined curvature efficiently with high accuracy and a relatively simple and low-cost configuration.

Now, a bending apparatus and a bending method for a plate-shaped metal workpiece according to an embodiment of the present invention are described with reference to the attached drawings. Note that, the present invention is not limited to the embodiment described below.

The inventors of the present invention have focused on the fact that a plurality of pocket grooves (dents) having various shapes are formed in an inner surface (on a side of a center of a curvature radius) of an outer-plate (or a skin) of an aircraft to be formed into a cylindrical shape, but an outer surface (opposite surface) of the outer-plate is flat and has no pocket. Thus, the inventors of the present invention have created a method of bending an outer-plate workpiece (plate-shaped workpiece) into a cylindrical shape (at a predetermined curvature) by sucking and pulling the outer surface (on a side opposite to the center of the curvature radius) of the outer-plate of the aircraft to be formed into a cylindrical shape, thereby forcibly deforming the outer-plate workpiece (plate-shaped workpiece) through the pulling.

The suction is performed using a suction pad (such as vacuum suction and magnetic attraction), and a position of the suction pad in a height direction (position thereof in an up-and-down direction in FIG. 2A to FIG. 2F) can be controlled by a servo screw jack (actuator capable of performing position control) or the like.

Specifically, as illustrated in FIG. 1C to FIG. 1E, FIG. 2A to FIG. 2F, FIG. 3A to FIG. 3E, FIG. 4A, and FIG. 4B, in a bending apparatus 1 for a plate-shaped workpiece according to this embodiment, a plurality of servo screw jacks 20A to 20G each having a suction pad 10 (suction cup in a case of vacuum suction) mounted to a distal end thereof are mounted to a bed 2 through pivots 21*a* to 21*g*.

Note that, the suction pad 10 corresponds to an example of a suction device according to the present invention, and the servo screw jacks 20A to 20G correspond to an example of expansion and contraction devices according to the present invention. Further, the bed 2 corresponds to an apparatus base according to the present invention.

Figures 1A, 1B:
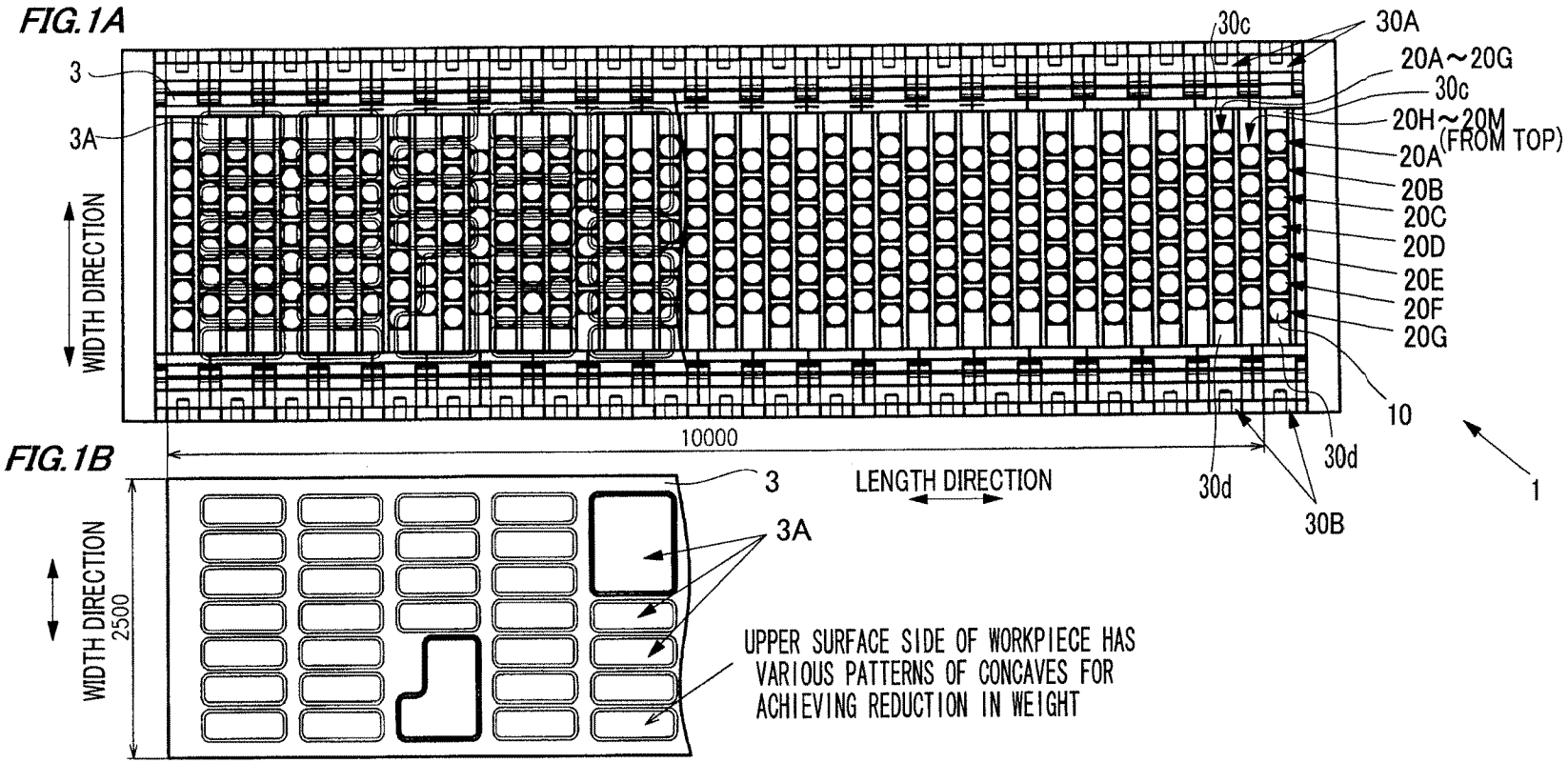
FIG. 1A is a plan view (top view) of a bending apparatus for a plate-shaped metal workpiece according to an embodiment of the present invention.
FIG. 1B is a partial plan view (top view) of a plate-shaped metal workpiece to be formed by the bending apparatus for a plate-shaped metal workpiece.

In this embodiment, as the plate-shaped workpiece (plate-shaped metal workpiece) 3 being a workpiece for an outer-plate of an aircraft and the like, a metal material such as extra-super duralumin (2524 T3) is exemplified. As illustrated in FIG. 1A and FIG. 1B, for example, the plate-shaped workpiece 3 has approximately a size of a thickness of from 2 mm to 10 mm×a width of 2.5 m×a length of from 6 m to 10 m. Further, as illustrated in FIG. 1B, a plurality of pocket grooves (dents) 3A having various shapes are formed (carved) in an upper surface of the plate-shaped workpiece 3.

As illustrated in FIG. 1C, FIG. 2A to FIG. 2F, FIG. 4A, and FIG. 4B, the servo screw jacks 20A to 20G are arranged in line along a circumferential direction of a cylindrical shape of the plate-shaped workpiece 3 to be bent into the cylindrical shape (arc shape) (along a width direction of the plate-shaped workpiece 3). Further, the servo screw jacks 20A to 20G are supported by the pivots 21*a* to 21*g* in a pivotable manner, respectively, and the servo screw jacks 20A to 20G are pivoted so that a center axis of each of the servo screw jacks 20A to 20G in a longitudinal direction (a center axis thereof in an expansion-and-contraction direction) is moved toward a center of a curvature radius of the plate-shaped workpiece 3 to be bent into the cylindrical shape at a predetermined curvature (along a direction of a normal line of the cylindrical shape).

Further, as illustrated in FIG. 1A, the servo screw jacks 20A to 20G are arranged in a plurality of rows along a length direction of the plate-shaped workpiece 3. In this embodiment, in the length direction, servo screw jacks 20H to 20M are arranged between a row of the servo screw jacks 20A to 20G and another row of the servo screw jacks 20A to 20G adjacent thereto. Further, the servo screw jacks are arranged in a staggered pattern so that center positions of the suction pads 10 can be as close to each other as possible in the length direction, specifically, the servo screw jacks are arranged in a staggered pattern so that, in the width direction, the servo screw jack 20H is arranged between the servo screw jacks 20A and 20B, and the servo screw jack 20I is arranged between the servo screw jacks 20B and 20C.

In the following, the servo screw jacks 20A to 20G are described as a representation of the plurality of servo screw jacks.

The bending apparatus 1 for a plate-shaped workpiece configured as described above bends the plate-shaped workpiece 3 into a cylindrical shape (arc shape) at a predetermined curvature in the following steps.

In Step 1 (represented by S1 in FIG. 2A, the same holds true for the following description), as illustrated in FIG. 2A and FIG. 1C, height positions of the suction pads 10 of the respective servo screw jacks 20A to 20G (expansion and contraction amount of the respective servo screw jacks 20A to 20G) are adjusted so that the suction pads 10 are brought into a flat form. This form is a standby form (or standby state). In this standby form, the plate-shaped workpiece 3 is carried and set onto the suction pads 10.

In Step 2 (S2), as illustrated in FIG. 2B, the suction pads 10 suck a lower surface (surface having no pocket groove) of the plate-shaped workpiece 3.

In Step 3 (S3), as illustrated in FIG. 2C and FIG. 1D, bender-cum-clamp members 30A and 30B support vicinities of both widthwise ends of the plate-shaped workpiece 3 from below. Further, under a state in which the suction pads 10 suck the plate-shaped workpiece 3, through position control (control of expansion and contraction amounts of the respective servo screw jacks 20A to 20G), rods 20*a* to 20*g* of the respective servo screw jacks 20A to 20G are lowered (contracted) to predetermined positions where the predetermined curvature is obtained, thereby lowering the suction pads 10. In this manner, a vicinity of a widthwise center of the plate-shaped workpiece 3 is subjected to plastic working (bent into a cylindrical shape) at a predetermined curvature (with a curvature radius R of approximately 1,000 mm).

Note that, springback of extra-super duralumin is significant. Thus, when the extra-super duralumin is deformed at a curvature with a curvature radius R of approximately 1,000 mm, the extra-super duralumin having a curvature with a curvature radius R of approximately 3,000 mm is obtained after being released (see FIG. 1D).

In this case, positions of both widthwise end portions of the plate-shaped workpiece 3 are shifted inward in accordance with bending deformation of the plate-shaped workpiece 3. Accordingly, the bender-cum-clamp members 30A and 30B, which support the vicinities of the both widthwise ends of the plate-shaped workpiece 3 from below, are movable inward in accordance with the inward shifting of the plate-shaped workpiece 3.

Figure 5A:
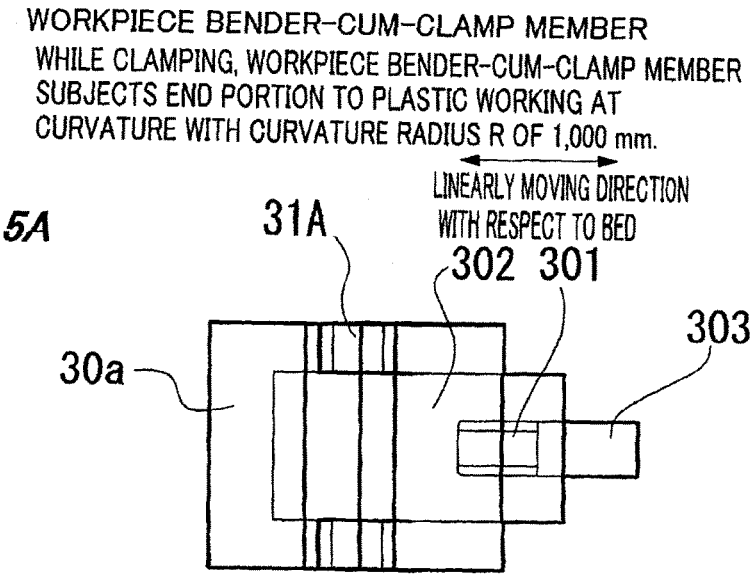
FIG. 5A is an enlarged side view for illustrating a configuration example of one of bender-cum-clamp members of the bending apparatus for a plate-shaped metal workpiece according to the embodiment of the present invention.
Figure 5B:
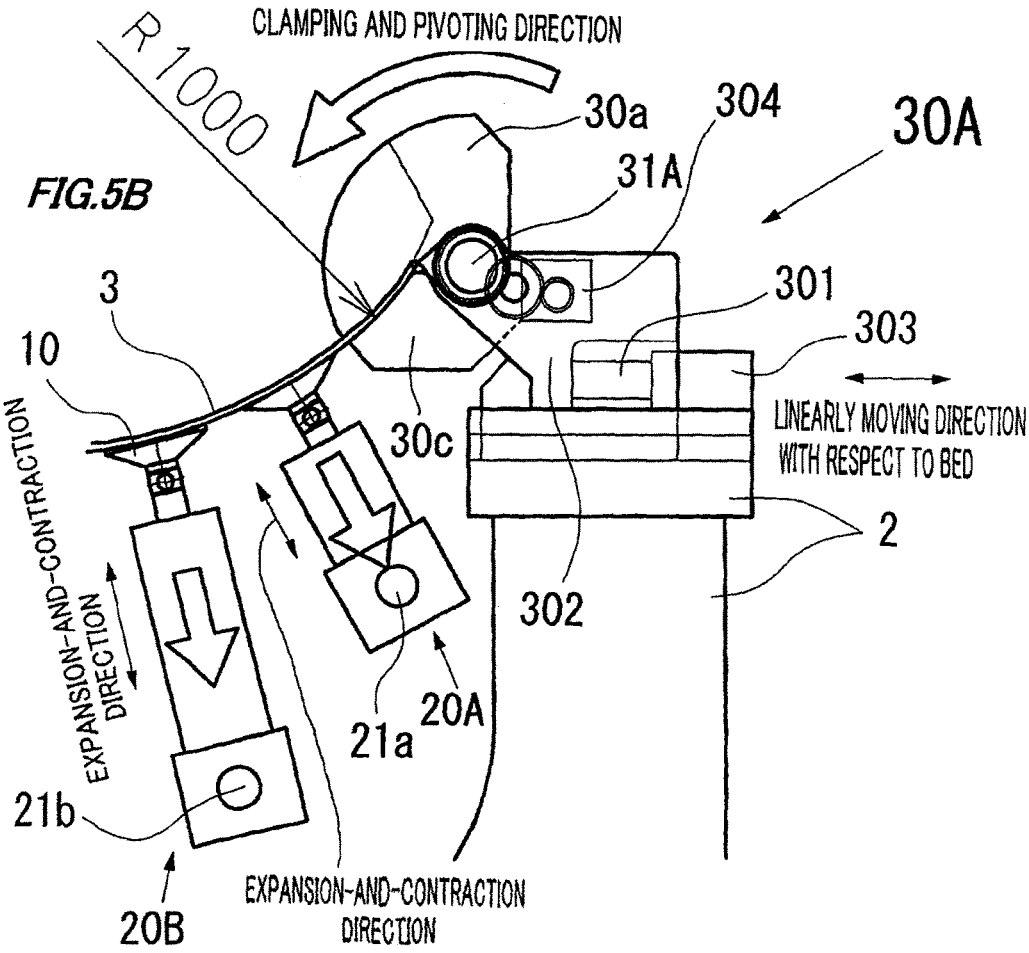
FIG. 5B is a partial plan view (top view) of the one of bender-cum-clamp members.

Specifically, the bender-cum-clamp member 30A (30B) is constructed as illustrated in FIG. 5A and FIG. 5B. Horizontal movement of the bender-cum-clamp member 30A (30B) in the width direction can be achieved using a linear guide mechanism or the like capable of controlling a position of a body base 302 of the bender-cum-clamp member 30A, which is threadingly engaged with a rotary screw 301, relatively to the bed 2 in such a manner that the rotary screw 301 is rotated by a servomotor 303.

In Step 4 (S4), as illustrated in FIG. 2D, the both widthwise ends of the plate-shaped workpiece 3 are nipped by the bender-cum-clamp members 30A and 30B, respectively. Further, the bender-cum-clamp member 30B illustrated on the left side in FIG. 2D is pivoted (or rotated) clockwise by a predetermined angle, and the bender-cum-clamp member 30A illustrated on the right side in FIG. 2D is pivoted (or rotated) counterclockwise by a predetermined amount (predetermined rotation angle) (rotation angle position control is performed). Thus, the vicinities of the both widthwise ends are subjected to plastic working (bent into a cylindrical shape) at the predetermined curvature (with the curvature radius R of approximately 1,000 mm). At this time, in order to obtain the predetermined curvature (with the curvature radius R of approximately 1,000 mm) at the vicinities of the both widthwise ends, positions of the servo screw jacks 20A to 20G are controlled by preset control amounts, and positions of the corresponding suction pads 10 are controlled to appropriate positions.

In this case, the bender-cum-clamp members 30A and 30B correspond to an example of a clamping device according to the present invention.

As illustrated in FIG. 2D, FIG. 5A, and FIG. 5B, the bender-cum-clamp members 30A and 30B nip the widthwise end portions of the plate-shaped workpiece 3 between a claw portion (nipper portion) 30*a* and a base portion 30*c* and between a claw portion (nipper portion) 30*b* and a base portion 30*d* by pivoting the claw portions 30*a* and 30*b* that are respectively pivoted about pivot shafts 31A and 31B by a servomotor 304 or the like. In this nipping state, the bender-cum-clamp members 30A and 30B further pivot the claw portions 30*a* and 30*b* and the base portions 30*c* and 30*d* about the pivot shafts 31A and 31B by a predetermined amount (predetermined rotation angle) (rotation angle position control is performed), thereby being capable of subjecting (bending into a cylindrical shape) the vicinities of the both widthwise ends to plastic working at the predetermined curvature (with the curvature radius R of approximately 1,000 mm).

Note that, as illustrated in FIG. 5A, opposing surfaces of the claw portion (nipper portion) 30*a* and the base portion 30*c* and opposing surfaces of the claw portion (nipper portion) 30*b* and the base portion 30*d* are each formed to have a curvature with a curvature radius R of approximately 1,000 mm.

In Step 5 (S5), as illustrated in FIG. 2E, the suction pad 10 of the servo screw jack 20D, which is positioned at a widthwise center portion among the servo screw jacks 20A to 20G, is lifted through position control, and a region to be bent at the predetermined curvature (with the curvature radius R of approximately 1,000 mm) is enlarged toward the widthwise end portions.

At this time, in order to achieve enlargement of the region to be bent at the predetermined curvature (with the curvature radius R of approximately 1,000 mm) toward the widthwise end portions, rotation angle positions of the bender-cum-clamp members 30A and 30B are controlled by preset control amounts, and positions of the other servo screw jacks 20A to 20C and 20E to 20G are also controlled by preset control amounts. Thus, positions of the corresponding suction pads 10 are controlled to appropriate positions.

In Step 6 (S6), as illustrated in FIG. 2F, the suction pads 10 of the servo screw jacks 20C and 20E, which are adjacent to the servo screw jack 20D positioned at the widthwise center portion among the servo screw jacks 20A to 20G, are lifted up through position control, and the region to be bent at the predetermined curvature (with the curvature radius R of approximately 1,000 mm) is further enlarged toward the widthwise end portions.

At this time, in order to achieve enlargement of the region to be bent at the predetermined curvature (with the curvature radius R of approximately 1,000 mm) toward the widthwise end portions, the rotation angle positions of the bender-cum-clamp members 30A and 30B are controlled by preset control amounts, and positions of the other servo screw jacks 20A, 20B, 20F, and 20G are also controlled by preset control amounts. Thus, positions of the corresponding suction pads 10 are controlled to appropriate positions.

In Step 7 (S7), as illustrated in FIG. 3A, similarly, the suction pads 10 of the servo screw jacks 20B, 20C, 20D, 20E, and 20F among the servo screw jacks 20A to 20G are lifted up through position control, and the region to be bent at the predetermined curvature (with the curvature radius R of approximately 1,000 mm) is further enlarged toward the widthwise end portions. The bender-cum-clamp members 30A and 30B, and the other servo screw jacks 20A and 20G are controlled in the same manner as that of Step 6.

In Step 8 (S8), as illustrated in FIG. 3B and FIG. 1E, the suction pads 10 of all of the servo screw jacks 20A to 20G are lifted up through position control, and the region to be bent at the predetermined curvature (with the curvature radius R of approximately 1,000 mm) is enlarged up to the widthwise end portions.

As described above, after the servo screw jacks 20A to 20G (plurality of expansion and contraction devices) are expanded or contracted in the same direction (in a downward direction in FIG. 2A to FIG. 2F and FIG. 3A to FIG. 3E) to form the plate-shaped workpiece 3 under bending deformation (Steps 3 and 4), the servo screw jacks 20A to 20G are sequentially (gradually) expanded or contracted in a direction opposite to the same direction (in an upward direction in FIG. 2A to FIG. 2F and FIG. 3A to FIG. 3E) from the innermost servo screw jack 20D (from two servo screw jacks (20J and 20K) when two servo screw jacks are positioned at a vicinity of a center among the servo screw jacks as in a case of the servo screw jacks 20H to 20M) toward the outermost servo screw jacks 20A and 20G, thereby forming the plate-shaped workpiece 3 under bending deformation (Steps 5, 6, 7, and 8). In this manner, bending deformation at the predetermined curvature can be gradually enlarged from the inner side toward the outer side of the plate-shaped workpiece 3. Accordingly, forming can be performed uniformly on an entire widthwise region of the plate-shaped workpiece 3 at a relatively small curvature with good accuracy.

In Step 9 (S9), as illustrated in FIG. 3C, the region to be bent at the predetermined curvature (with the curvature radius R of approximately 1,000 mm) reaches the widthwise end portions in Step 8 so that the forming is finished. Accordingly, the bender-cum-clamp members 30A and 30B are released.

In Step 10 (S10), as illustrated in FIG. 3D, loads applied to the respective rods 20*a* to 20*g* of the servo screw jacks 20A to 20G are detected by a load sensor or the like, and positions of the rods (lengths of the rods) of the servo screw jacks 20A to 20G are controlled so as to equalize the loads applied to the respective rods 20*a* to 20*g*. In this manner, in a state without deflection due to a self-weight, a contour (curvature or profile) of the plate-shaped workpiece 3 can be measured, and whether or not a predetermined contour (curvature or profile) is obtained can be inspected.

Accordingly, as compared to a case of performing measurement under a state in which the plate-shaped workpiece 3 deflects due to the self-weight as in the related art, an actual contour (curvature or profile) can be obtained with good accuracy.

Note that, unlike a press brake (forming machine), the bending apparatus 1 for a plate-shaped workpiece according to this embodiment does not include a component such as a punch (slide) arranged above the plate-shaped workpiece 3. Accordingly, after the forming is performed, on the forming spot (under a state in which the plate-shaped workpiece 3 is placed on the suction pads 10 of the servo screw jacks 20A to 20G), the contour (curvature or profile) of the plate-shaped workpiece 3 can be measured using a three-dimensional shape measuring device 50 employing a laser. Thus, as compared to the related-art case where the plate-shaped workpiece 3 is temporarily moved from the press brake (forming machine) to a wide space in order to measure the contour (curvature or profile) of the plate-shaped workpiece 3, the bending apparatus 1 can contribute to simplification of work of measuring the contour, reduction of working hours, and the like, and also can increase production efficiency.

Whether or not the predetermined contour (curvature or profile) is obtained is determined based on the measurement result obtained in Step 10 (S10). When the predetermined contour (curvature or profile) is not obtained, Step 3 to Step 10 are repeated. In consideration of a difference between a target value and a measurement value, position control is performed on the suction pads 10 of the servo screw jacks 20A to 20G so as to obtain the predetermined contour (curvature or profile).

On the other hand, when the predetermined contour (curvature or profile) is obtained in Step 10, bending steps proceed to Step 11 (S11). As illustrated in FIG. 3E, sucking of the suction pads 10 of the servo screw jacks 20A to 20G is cancelled. Thus, the plate-shaped workpiece 3 is released, and then carried to an outside.

In this case, as illustrated in FIG. 2A to FIG. 2F, FIG. 4A, FIG. 4B, and the like, the servo screw jacks 20A to 20G according to this embodiment are constructed so that the rods 20*a* to 20*g* thereof serving as output portions are expanded and contracted (moved upward and downward) with respect to bodies of the servo screw jacks 20A to 20G.

Specifically, each of the servo screw jacks 20A to 20G can control an expansion and contraction amount of each of the rods 20*a* to 20*g* by rotating a built-in screw by an electric motor while controlling a rotation amount of the built-in screw. Further, the suction pad 10 is mounted in a rockable manner to a tip of each of the rods 20*a* to 20*g* through a spherical joint, a universal joint, or the like.

Figure 4A:
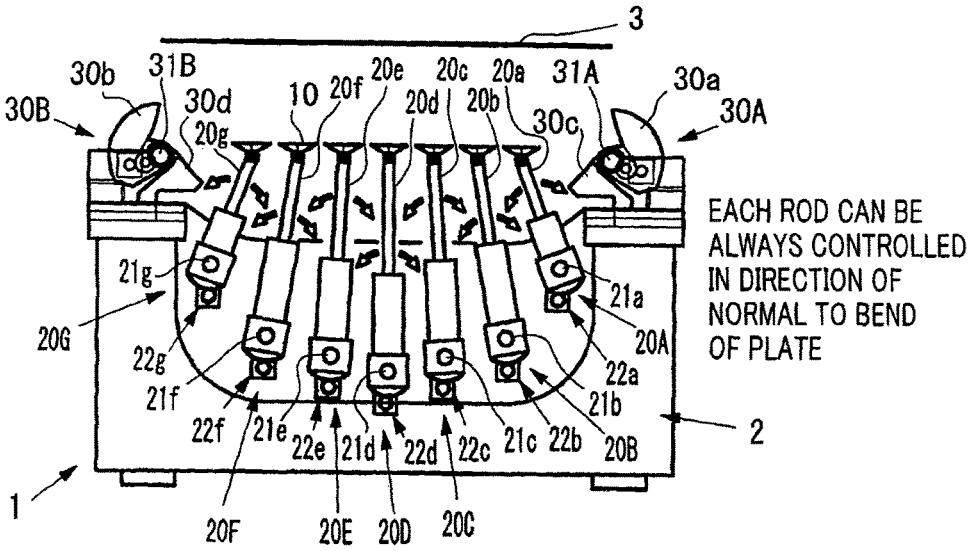
FIG. 4A is a side view for illustrating a state in which pivotal movement (rocking angles) of servo screw jacks is controlled by servomotors with respect to a bed of the bending apparatus for a plate-shaped metal workpiece according to the embodiment of the present invention.

Further, as illustrated in FIG. 4A, the servo screw jacks 20A to 20G are mounted to the bed 2 so as to be pivotable about the pivots 21*a* to 21*g*, respectively. However, for example, pivotal movement amounts (rotation amounts) of the servo screw jacks 20A to 20G can be controlled by servomotors 22*a* to 22*g*, respectively.

With this configuration, when bending is performed by sucking the plate-shaped workpiece 3 using the suction pads 10, the expansion-and-contraction direction of each of the rods 20*a* to 20*g* (the center axis thereof in the longitudinal direction) can be always conformed to a direction of a normal to a bend of the plate-shaped workpiece 3. Accordingly, the plate-shaped workpiece 3 can be bent at the predetermined curvature efficiently and precisely.

Figure 4B:
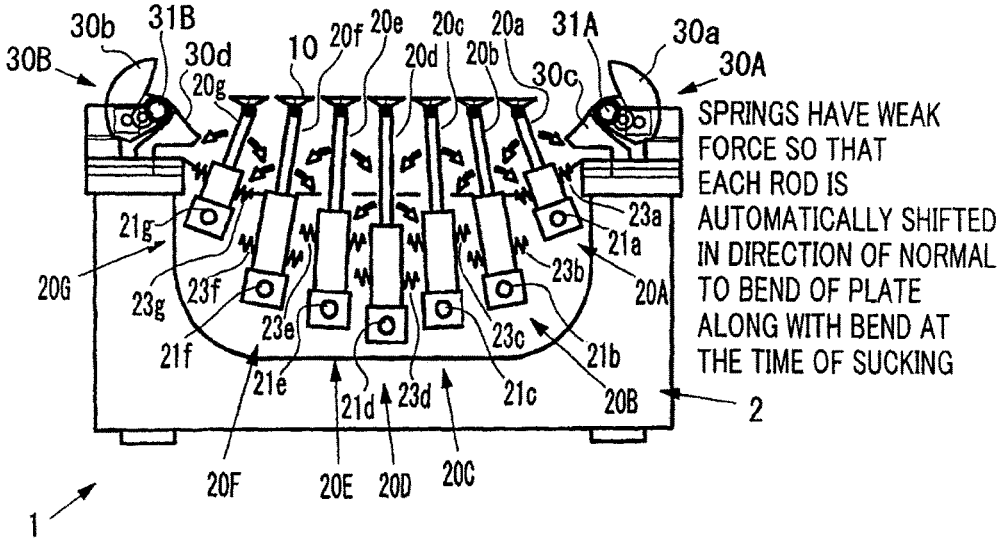
FIG. 4B is a side view for illustrating a state in which the pivotal movement (rocking angles) of the servo screw jacks is automatically controlled by springs with respect to the bed.

Further, as illustrated in FIG. 4B, instead of the servomotors 22*a* to 22*g*, springs 23*a* to 23*g* may support the servo screw jacks 20A to 20G to enable the servo screw jacks 20A to 20G to pivot about the pivots 21*a* to 21*g*, respectively.

When the springs 23*a* to 23*g* are each set to have a relatively low (weak) elastic force (restoring force), the expansion-and-contraction direction of each of the rods 20*a* to 20*g* (the center axis thereof in the longitudinal direction) can be automatically conformed to the direction of the normal to the bend along with the bend of the plate-shaped workpiece 3 when performing bending by sucking the plate-shaped workpiece 3 using the suction pads 10. Accordingly, the plate-shaped workpiece 3 can be bent at the predetermined curvature efficiently and precisely with a simple configuration.

As described above, according to the bending apparatus 1 for a plate-shaped workpiece of this embodiment, without performing cylindrical bending employing three-point bending as in the case of the related-art press brake, the suction pads 10 are moved while sucking one surface side of the plate-shaped workpiece 3, to thereby deform the plate-shaped workpiece 3. With this method, the plate-shaped workpiece 3 is bent into a cylindrical shape. Accordingly, even with a simple and low-cost configuration, the plate-shaped workpiece for an outer-plate of an aircraft and the like can be formed (bent into a cylindrical shape) at a predetermined curvature efficiently with high accuracy.

Further, unlike the related art, the bending apparatus 1 for a plate-shaped workpiece according to this embodiment does not use a press brake significantly increased in size in order to ensure rigidity (to suppress deflection in the longitudinal direction). Accordingly, operation energy can be reduced, and also an operation cycle can be reduced. Consequently, production efficiency can be increased.

Figure 8:
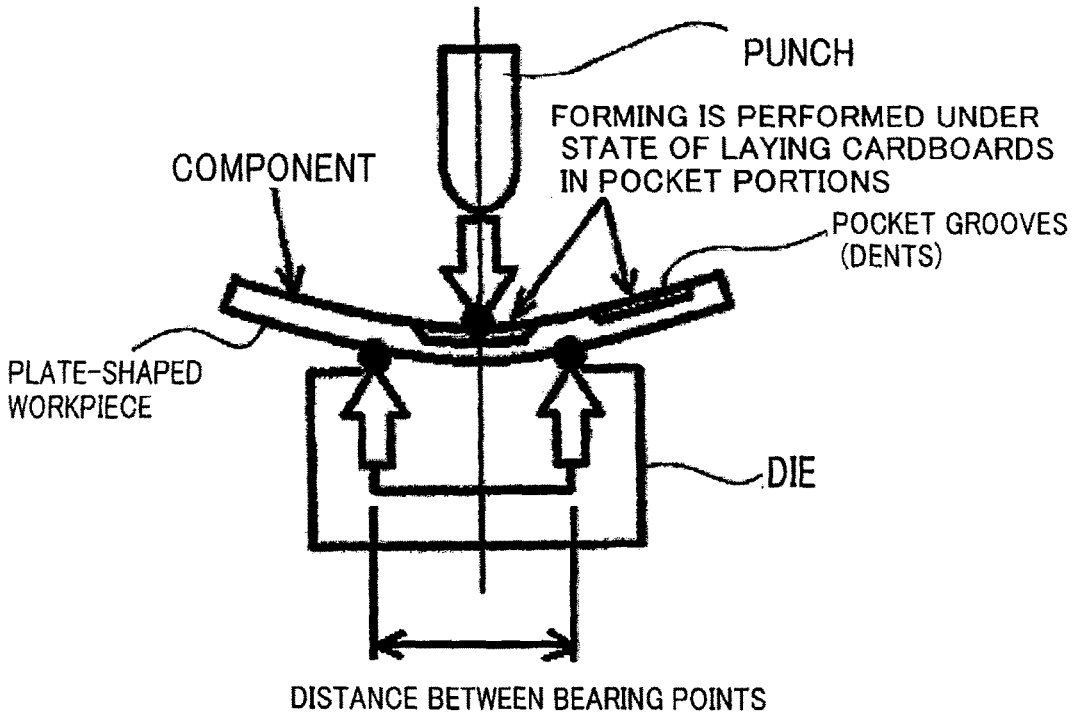
FIG.8 PRIOR ART
FIG. 8 is a side view for illustrating a related-art cylindrical bending method employing three-point bending.

Further, in a tip forming method, a distance between front and rear bearing points of a die (see FIG. 8) is small. As a result, a load applied to deform a workpiece is increased, and a press is required to have high capacity. However, according to the bending apparatus 1 for a plate-shaped workpiece of this embodiment, a distance between bearing points for a load (distance between the bender-cum-clamp members 30A and 30B) is large. Accordingly, the plate-shaped workpiece can be deformed with a relatively small load.

That is, according to this embodiment, it is possible to provide the bending apparatus and the bending method for a plate-shaped metal workpiece, which are capable of forming (bending into a cylindrical shape) the plate-shaped metal workpiece for an outer-plate of an aircraft and the like at the predetermined curvature efficiently with high accuracy and the relatively simple and low-cost configuration.

Figures 6A, 6B:
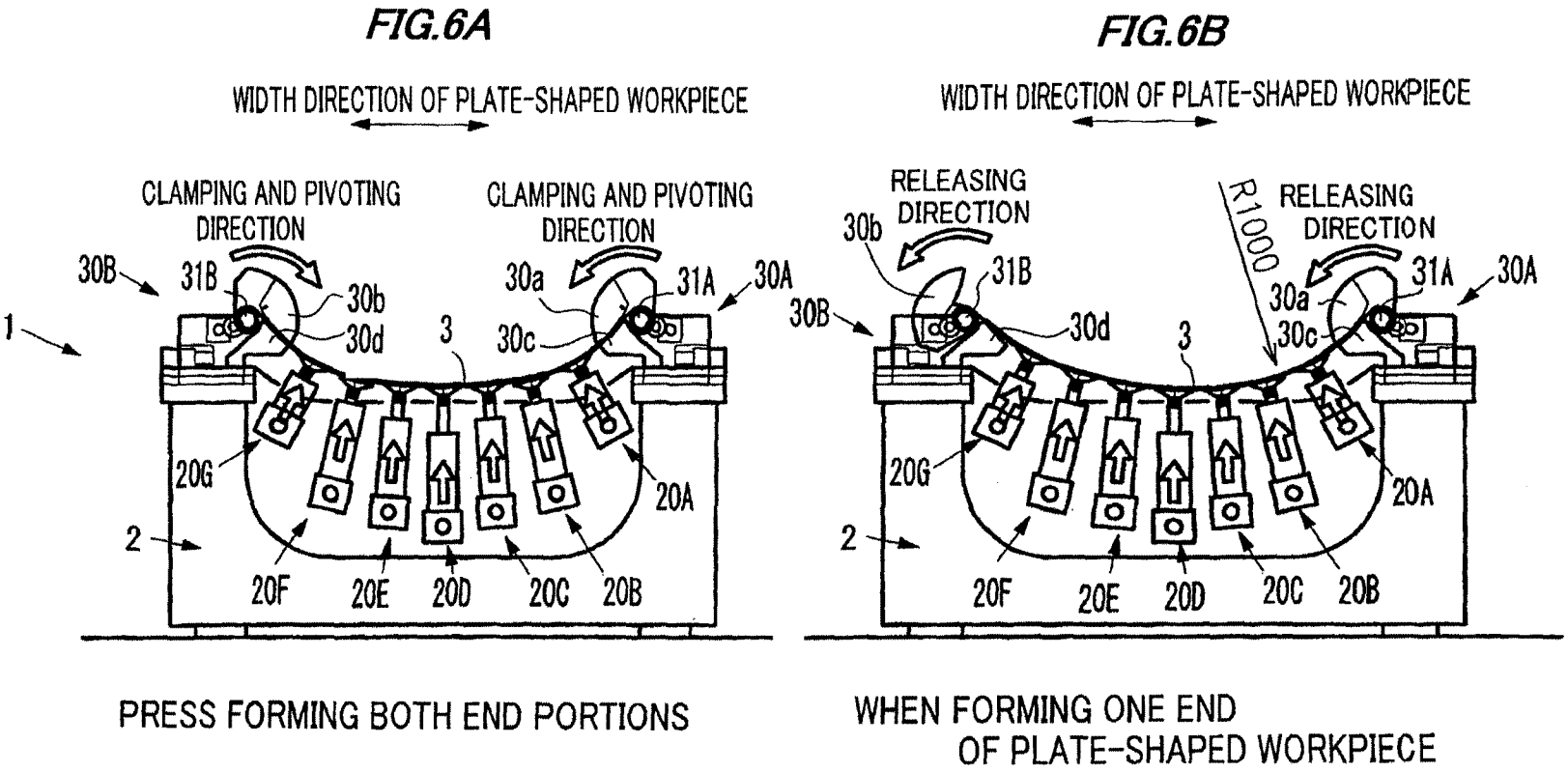
FIG. 6A is a side view for illustrating a forming method in a case of simultaneously bending both ends of the plate-shaped metal workpiece at a predetermined curvature by the servo screw jacks and the bender-cum-clamp members of the bending apparatus for a plate-shaped metal workpiece according to the embodiment of the present invention.
FIG. 6B is a side view for illustrating a forming method in a case of bending one end of the plate-shaped metal workpiece at a predetermined curvature.
Figures 7A, 7B:
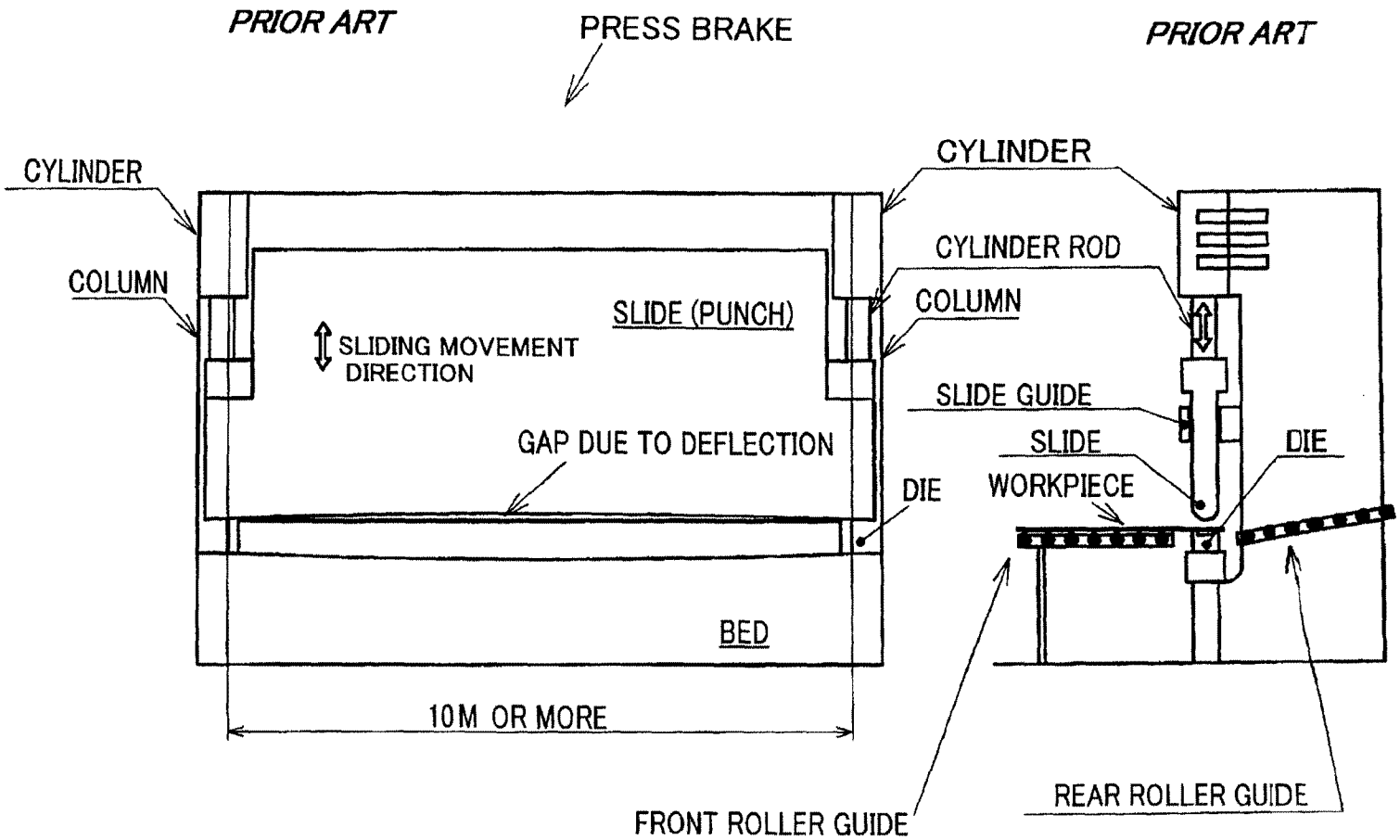
FIG.7A PRIOR ART
FIG.7B PRIOR ART
FIG. 7A is a view of a related-art press brake when viewed from a feeding direction (length direction) of a plate-shaped metal workpiece (view for illustrating a wide frontage of the press brake).
FIG. 7B is a side view of FIG. 7A.

Note that, an example of operation of the bender-cum-clamp members 30A and 30B is as follows. As illustrated in FIG. 6A (FIG. 2D and the like), under a state in which the bender-cum-clamp members 30A and 30B respectively nip the both widthwise end portions of the plate-shaped workpiece 3, the right bender-cum-clamp member 30A is pivoted (rotated) counterclockwise, and the left bender-cum-clamp member 30B is pivoted (rotated) clockwise, thereby being capable of bending and deforming the plate-shaped workpiece 3 at the predetermined curvature.

In addition, as illustrated in FIG. 6B, under a state in which the bender-cum-clamp member 30A nips a widthwise end portion of the plate-shaped workpiece 3, the right bender-cum-clamp member 30A is pivoted counterclockwise, whereas the left bender-cum-clamp member 30B is released, thereby bending and deforming a right end side of the plate-shaped workpiece 3 at a relatively small curvature. This operation method is assumable as the operation of the bender-cum-clamp members 30A and 30B.

Note that, in this embodiment, vacuum suction using the suction pads 10 can be employed. In addition, magnetic attraction using an electromagnet or the like may be employed depending on a material of the plate-shaped workpiece 3.

Further, in this embodiment, the workpiece for an outer-plate of an aircraft is described as an example of the plate-shaped workpiece 3, but the present invention is not limited thereto. As long as the plate-shaped workpiece can be bent and deformed while being sucked by the suction pads 10, the plate-shaped workpiece is not particularly limited thereto irrespective of whether or not the plate-shaped workpiece has pocket grooves (dents) formed therein.

Further, in this embodiment, description is made of the case where the plate-shaped workpiece 3 set in a substantially horizontal posture as illustrated in FIG. 1A to FIG. 1E, FIG. 2A to FIG. 2F, FIG. 3A to FIG. 3E, FIG. 6A, and FIG. 6B is deformed at a convex downward (concave upward) curvature, but the present invention is not limited thereto. The present invention is also applicable to a case where the plate-shaped workpiece 3 is deformed at a convex upward (concave downward) curvature.

Further, in this embodiment, the contour (curvature or profile) of the plate-shaped workpiece 3 after the forming is measured using the three-dimensional shape measuring device 50 employing a laser, and the forming is performed once or a plurality of times until the predetermined contour (curvature or profile) is obtained. However, the contour (curvature or profile) may be measured by another method (for example, a method of using a dial gauge or the like).

Further, in this embodiment, description is made of the configuration in which the bender-cum-clamp members 30A and 30B being the clamping device are arranged at the both widthwise ends of the plate-shaped workpiece 3, respectively. However, depending on a required curvature, both of the bender-cum-clamp members 30A and 30B may be omitted, or at least one of the bender-cum-clamp members 30A and 30B may be omitted.

Further, pivoting functions of the bender-cum-clamp members 30A and 30B may be omitted.

The embodiment described above is merely an example for describing the present invention. It goes without saying that various modifications may be made without departing from the gist of the present invention.

What is claimed is:

1. A bending apparatus for bending an unbent plate-shaped quadrilateral metal workpiece, comprising:

a support for supporting two edges of the workpiece;

suction devices configured to suck a surface of the workpiece;

actuators, each actuator configured to move one of the suction devices mounted thereon so as to pull a portion of the workpiece being sucked by the one of the suction devices away from an original position of the portion of the workpiece; and an apparatus base on which each of the actuators is mounted in a pivotable manner with respect to a moving direction of a respective one of the suction devices mounted on the each of the actuators.

2. The bending apparatus according to claim 1, wherein each of the suction devices is mounted in a rockable manner on corresponding one of the actuators.

3. The bending apparatus according to claim 1, wherein the support includes clamps each configured to clamp one of the two edges of the workpiece, and each supported pivotably on an axis parallel with the one of the two edge of the workpiece while clamping the one of the two edges of the workpiece.

4. The bending apparatus according to claim 3, wherein each clamp is movable in a direction perpendicular to the one of the two edges of the workpiece.

5. The bending apparatus for a bending a plate-shaped quadrilateral metal workpiece according to claim 3, wherein each clamp has curved surfaces holding the one of the two edges.

6. The bending apparatus according to claim 1, wherein a moving distance of each of the suction devices by a respective one of the actuators is controllable.

7. The bending apparatus according to claim 1, wherein after forming the workpiece under bending deformation by moving the respective suction devices in the same direction, the bending apparatus forms the workpiece under bending deformation by increasing or decreasing respective distances of the suction devices from the original positions in a sequential order from an innermost actuator toward an outermost actuator.

8. The bending apparatus according to claim 1, wherein the actuators are arranged in a staggered manner in plan view.

9. The bending apparatus according to claim 1, further comprising a three-dimensional shape measuring device which measures a contour of the workpiece on the suction devices from a surface of the workpiece opposite to the surface sucked by the suction devices.

10. The bending apparatus according to claim 1, the suction devices and the actuators are disposed only on one side of the workpiece to bend the workpiece only from one surface of the workpiece.

11. The bending apparatus according to claim 1, wherein each of the actuators is configured to move a respective one of the suction devices mounted thereon under a state in which the suction devices suck the workpiece so as to bend the workpiece.

12. A bending apparatus for bending an unbent plate-shaped metal workpiece, comprising:

suction devices configured to be attached to the workpiece;

actuators each configured to move corresponding one of the suction devices; and a support for supporting peripheral areas of the workpiece, wherein the actuators each pulls the corresponding one of the suction devices to bend the unbent plate-shaped metal supported by the support in a direction of pulling the suction devices.

13. The bending apparatus according to claim 12, wherein the actuators include first through $N^{th}$ actuators sequentially arranged in one direction, and wherein distances from a reference plane to proximal ends of the first actuator to the $N^{th}$ actuators gradually increase and then gradually decrease.

14. The bending apparatus according to claim 13, wherein an inclined angle, defined to be a distal end of a respective actuator to a proximal end of the respective actuator, first increases and then decreases from the first actuator toward the $N^{th}$ actuator.

15. The bending apparatus according to claim 12, wherein the actuators are configured to move the suction devices independently of each other.

16. The bending apparatus according to claim 12, wherein each of proximal ends of the actuators is mounted on a base in a pivotable manner with respect to a moving direction of a respective one of the suction devices.

17. The bending apparatus according to claim 12, wherein each of the suction devices is mounted on corresponding one of the actuators in a rockable manner.

18. The bending apparatus according to claim 12, wherein the actuators are configured to first move the suction devices toward of the actuators, and then move the suction devices away from of the actuators in a sequential order from an innermost actuator toward an outermost actuator.

19. The bending apparatus according to claim 12, the suction devices and the actuators are disposed only on one side of the workpiece to bend the workpiece only from one surface of the workpiece.

20. The bending apparatus according to claim 12, wherein
the plate-shaped metal workpiece has a quadrilateral shape, and
the support includes clamps each configured to clamp one of two edges of the workpiece and each supported pivotably on an axis parallel with the one of the two edges of the workpiece.

21. The bending apparatus according to claim 20, wherein each clamp is movable in a direction perpendicular to the one of the two edges of the workpiece.

22. The bending apparatus according to claim 20, wherein each clamp has curved surfaces holding the one of the two edges.

23. A bending apparatus for bending an unbent plate-shaped metal workpiece, comprising:
a support for supporting peripheral areas of the workpiece;
suction devices configured to be attached to the workpiece; and
a base;
connectors, attached to the base, each pivotally supporting one suction device, wherein each suction device comprises:
a suction cup to be attached to a surface of the workpiece, the suction cup covering at least a point on the surface;
a rod, one end of which is coupled to the suction cup; and
an actuator, to which another end of the rod is coupled, configured to push and pull the rod, and
each connector is configured to pivotally support one suction device to maintain the rod of the one suction device to be normal to the surface of the workpiece at the point while the actuator of the one suction device pulls the rod to bend the workpiece.

24. The bending apparatus according to claim 23, further comprising supports each configured to maintain one suction device in its initial position.

25. The bending apparatus according to claim 23, wherein each connector includes a motor configured move the rod to maintain a direction of the rod to be normal to the surface of the workpiece at the point depending on progress of bending the workpiece.

26. The bending apparatus according to claim 23, wherein
the plate-shaped metal workpiece has a quadrilateral shape, and
the support includes clamps each configured to clamp one of two edges of the workpiece and each supported pivotably on an axis parallel with the one of the two edges of the workpiece.

27. The bending apparatus according to claim 26, wherein each clamp is movable in a direction perpendicular to the one of the two edges of the workpiece.

28. The bending apparatus according to claim 26, wherein each clamp has curved surfaces holding the one of the two edges.

29. The bending apparatus according to claim 23, wherein suction cups of the suction devices are arranged in a staggered manner in plan view.

30. A bending apparatus for bending a plate-shaped metal workpiece, comprising:
suction devices configured to be attached to the workpiece; and
a base;
connectors, attached to the base, each pivotally supporting one suction device, wherein each suction device comprises:
a suction cup to be attached to a surface of the workpiece, the suction cup covering at least a point on the surface;
a rod, one end of which is coupled to the suction cup; and
an actuator, to which another end of the rod is coupled, configured to push and pull the rod, and
suction cups of the suction devices are arranged in a staggered manner in plan view.

31. The bending apparatus according to claim 30, further comprises a support for supporting peripheral areas of the workpiece.

32. The bending apparatus according to claim 31, wherein
the plate-shaped metal workpiece has a quadrilateral shape, and
the support includes clamps each configured to clamp one of two edges of the workpiece and each supported pivotably on an axis parallel with the one of the two edges of the workpiece.

33. The bending apparatus according to claim 32, wherein each clamp is movable in a direction perpendicular to the one of the two edges of the workpiece.

34. The bending apparatus according to claim 32, wherein each clamp has curved surfaces holding the one of the two edges.

* * * * *